United States Patent [19]

Fischer

[11] Patent Number: 4,664,183

[45] Date of Patent: May 12, 1987

[54] PLATE HEAT EXCHANGER AND PRESSING TOOL FOR THE PRODUCTION THEREOF

[76] Inventor: Helmut Fischer, Kuniglberggasse 5, A-1130 Wien, Austria

[21] Appl. No.: 753,247

[22] Filed: Jul. 9, 1985

[51] Int. Cl.[4] ..... F28F 3/04; F28F 3/08

[52] U.S. Cl. ..... 165/166; 165/167

[58] Field of Search ..... 165/166, 167

[56] References Cited

U.S. PATENT DOCUMENTS

| | | | |
|---|---|---|---|
| 1,826,344 | 10/1931 | Dalgliesh | 165/166 X |
| 2,281,754 | 5/1942 | Dalzell | 165/167 |
| 2,610,834 | 9/1952 | Dalzell | 165/167 X |
| 4,043,388 | 8/1977 | Zebuhr | 165/166 |
| 4,470,453 | 9/1984 | Laughlin et al. | 165/167 X |
| 4,569,391 | 2/1986 | Hulswitt et al. | 165/166 |

FOREIGN PATENT DOCUMENTS

| | | | |
|---|---|---|---|
| 859480 | 12/1952 | Fed. Rep. of Germany | 165/166 |
| 19649 | 10/1982 | Fed. Rep. of Germany | 165/166 |
| 977651 | 4/1951 | France | 165/166 |
| 1053252 | 2/1954 | France | 165/166 |
| 587784 | 4/1958 | Italy | 165/166 |
| 0137459 | 11/1978 | Japan | 165/166 |
| 0137460 | 11/1978 | Japan | 165/166 |
| 0156193 | 9/1983 | Japan | 165/166 |
| 289677 | 5/1928 | United Kingdom | 165/167 |
| 1126066 | 9/1968 | United Kingdom | 165/166 |
| 0787877 | 12/1980 | U.S.S.R. | 165/166 |
| 0827960 | 5/1981 | U.S.S.R. | 165/166 |

*Primary Examiner*—Albert W. Davis, Jr.
*Assistant Examiner*—Randolph A. Smith
*Attorney, Agent, or Firm*—Lackenbach Siegel Marzullo & Aronson

[57] ABSTRACT

A plate heat exchanger comprises a plurality of heat exchanger plates made from sheet metal. Each plate has a center part which is used for heat exchange and is provided with a plurality of parallel wavelike impressions. The wavelike impressions being arranged in a plurality of circular wave fields that cover substantially the center part of the plate.

8 Claims, 6 Drawing Figures

PLATE HEAT EXCHANGER AND PRESSING TOOL FOR THE PRODUCTION THEREOF

The invention relates to a plate heat exchanger consisting of a stack of successively joined heat exchange plates which are pressed from sheet metal and inserted between two solid plates. The center zone of the heat exchange plates serving as the the heat exchange zone or area is provided with impressions which increase turbulence and, thus, heat transfer.

It is an object of the invention to shape the center part of the plates so that it becomes possible, within a certain range, to provide the heat exchange plate with any thermal length desired.

If one proceeds from that, the dimensions of the centre part of the plate serving as the heat exchange are determined, i.e. the length and width thereof, and the distance to an adjacent plate, then the thermal length of this type of plate is even more determined by the shape of the profile of the center part.

In many fields in which plate heat exchangers are applied, especially in large apparatus which are utilized for cooling, it is required that the total heat transfer efficiency occur along the length of *one* plate path (channel), i.e. in such apparatus all plates must be connected in parallel, and both media flow through the apparatus countercurrently. If one proceeds from that for a given problem posed there must also occur a certain loss of pressure within the heat exchanger, then due to that there is also given an ideal thermal length of a heat exchanger or the plates thereof.

This length is provided when in the case of a given pressure loss such an amount of fluid is passed through the plate channel at which the desired temperature change occurs. If the thermal length of the plate type used is too big, it is necessary, in order not to exceed the maximum pressure loss, to insert more heat exchange plates into the apparatus than is required for the thermal effect and, thus, the apparatus is overdimensioned.

On the other hand, if the thermal length is too small, the rate of flow per plate channel must be reduced to such an extent that the temperature program is fulfilled. But a decrease of admission to the plate simultaneously effects a decrease of the heat-transfer coefficient, such that such types of heat exchangers often require a substantially greater exchange area than the heat exchangers having a correct thermal length.

To prevent these known facts, heat exchange plates of the same size are built with different profiles so that, if need be, one can get closer to the ideal thermal length. Most modern plates have a profile in their center part which consists of waves extending transversely to the longitudinal axis and, thus, also to the direction of flow; these waves cross the oppositely directed waves of the neighboring plate. The angles which enclose these waves with respect to the longitudinal axis, lie generally between 35° and 65°. They are of determining importance for the thermal length of the plate and can affect it in a ratio of about 1:4. Thus, it is assumed that the thermal length decreases by diminishing the angle.

According to a prior art system there are applied two plate types with different angles of the waves which—each used for itself—ensure flow channels with a long and short thermal length. A combination due to an alternate use of both plate types results in channels of medium thermal length. It is evident that this system enables only an approximate gradation of the thermal lengths and, therefore, is not satisfactory.

According to another proposal the center part of the plate is subdivided into a plurality of lamellar fields extending transversely to the longitudinal axis which, on their part, have waves of a different angle of inclination with respect to the longitudinal axis.

The lamellar fields are formed in the pressing tool by means of exchangeable formed parts. Due to a simultaneous use of fields with a large angle and fields with a small angle it is possible to change the thermal length of a plate. In this case it is, indeed, possible to get closer to an ideal length, but this construction also has deficiencies. In the case of flow conditions in the turbulent range, a profile having a small angle will yield a heat-transfer coefficient which lies 50% below that which is obtained for a profile having a large angle, when acting upon both profiles with the same amount of fluid. This leads to a medium heat-transfer coefficient which lies below that which is obtained when a uniform profile is selected with an angle yielding precisely the thermal length of the plate channel which is required.

In the case of the subject matter of the invention, this is achieved by means of the following measures:

The center part of the plate has numerous densely joined circular fields comprising wavelike impressions. The waves are directed transversely to the longitudinal axis of the plates. For manufacturing the plate there is used a pressing tool in which center part disc-like dies are inserted, the upper side of which has a profile which is suitable for stamping the waves. The dies per se are mounted pivotably in the tool so that it is possible to change the angle which the waves form with respect to the longitudinal axis of the pressing tool and, thus, heat exchange plate. In that way the heat exchange plate may be provided with precisely that profile which is needed to obtain the required thermal length.

For achieving the desired effect various embodiments are possible. Some of them are described hereinafter.

Figure 1:
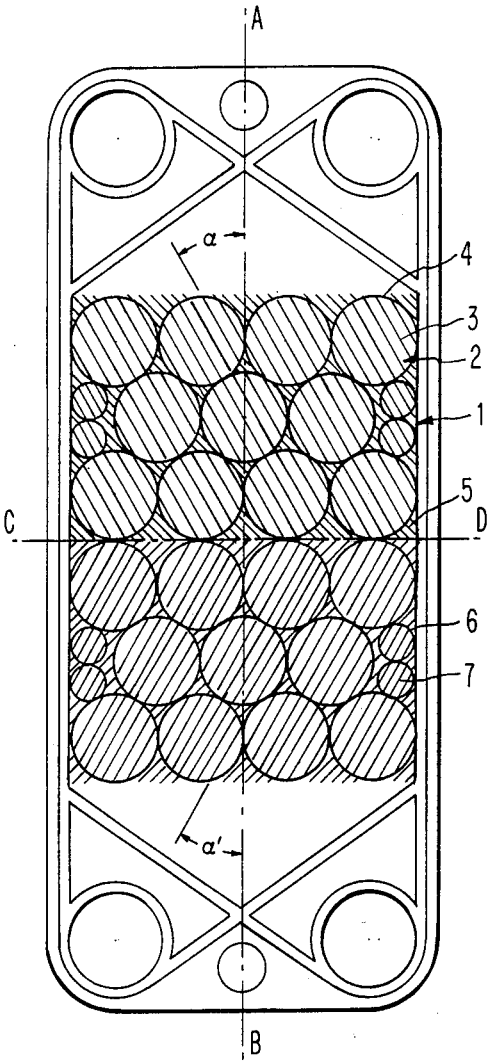
FIG. 1 shows a heat exchange plate whose center part has impressions which are disposed symmetrically with respect to the transverse axis CD in elevation.

FIG. 1 shows a heat exchange plate in plan view. Numerous circular fields 2 are pressed in its center part 1. These fields consist of waves 3 which are shown in the drawing as lines. In order to make the representation clearer, the wave fields in the drawing are encircled with line 4. The remaining spaces which lie among the circular fields are furnished with waves 5. Spaces in the center part, which for structural (geometrical) reasons are too small to mount the field 2, may be provided with correspondingly smaller circular fields 6 which also comprise waves 7. Waves 3 of the upper portion of the center part form a definite angle $\alpha$ with respect to the center line AB. In the lower portion, which is mirror-inverted to it, there is formed an angle $\alpha'$ of the same size. In the drawing this angle is 30°. The center part of the neighboring plate is turned by 180° about a center line which is vertical to the surface of the plate so that the waves of both plates cross and one field lies above the other. The angle of crossing of the waves is then $2\alpha$, this being 60°. This angle would bring about a flow channel of short thermal length.

Figure 2:
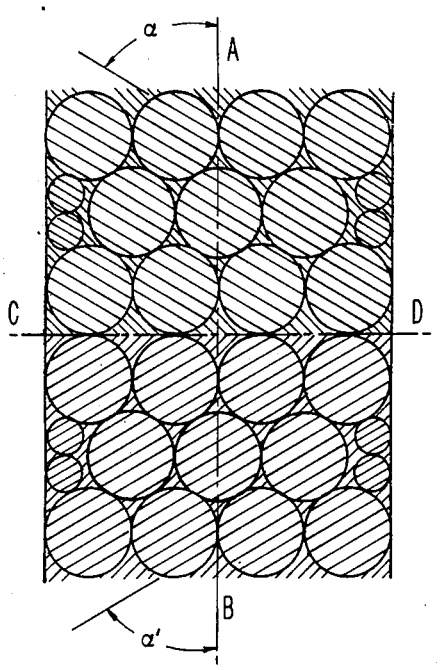
FIG. 2 shows a section of the same center part in which the angle of the waves is changed.

FIG. 2 shows the center of a similarly shaped heat exchange plate in which, however, the angle $\alpha$ is 60°. The angle of crossing of such two plates is 120°, which corresponds to a profile of large thermal length.

Figure 3:
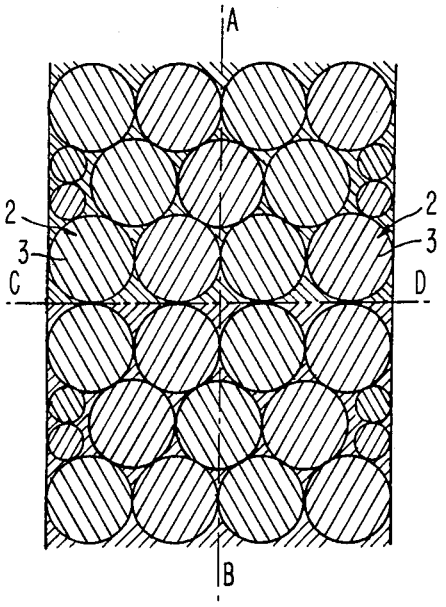
FIG. 3 shows the same section of the part, but with a different arrangement of the direction of the waves.

FIG. 3 shows a center part whose wave fields 2 in the horizontal rows exhibit a constantly changing direction of waves 3. When two neighboring plates are superposed, the waves cross and, thus, the same effect as in the case of the plate in FIG. 1 is obtained.

Figure 4:
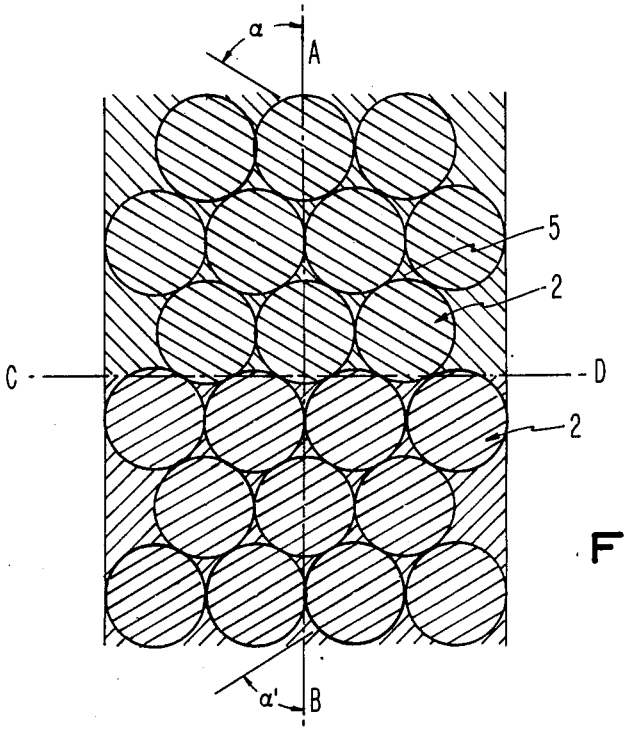
FIG. 4 shows a center part of a plate which is made asymmetric with respect to the transverse axis CD.

FIG. 4 shows a center part in which the wave fields 2 are not mounted in a mirror-inverted fashion with regard to the transverse axis CD, but are mounted in displacement to one another. This brings about that in the case of two consecutive plates whose center parts are displaced relative to each other about a center line being vertical to the surface of the plate by about 180°, wave fields 2 overlap waves 5 lying in the small interzones. In this way one achieves an especially homogeneous development of the flow channels.

Figure 5:
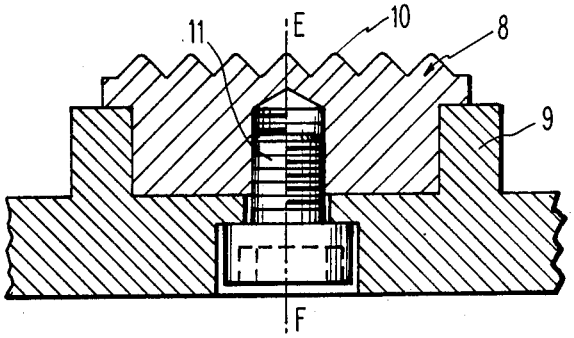
FIG. 5 shows a press die for the production of a circular wave field and a section of a part of a pressing tool in profile.
Figure 6:
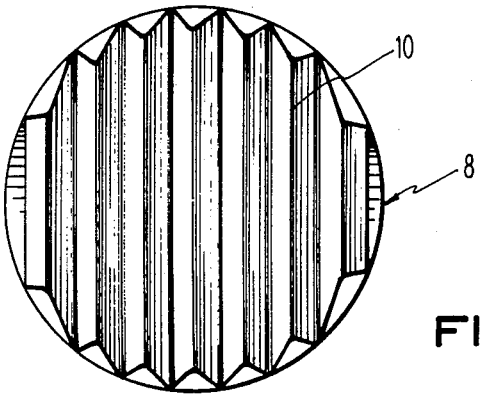
FIG. 6 is a topview of the same press die.

FIG. 5 shows a press die 8 in profile for the production of a wave field 2. FIG. 6 is a topview of the press die 8. This round toolmember is embedded in the main plate 9 of the pressing tool and is fastened with a central screw 11. This construction makes a displacement of the press die feasible and, thus, of any variation of the direction of the ribs 10 in the pressing tool. If the tool section represented is viewed as the lower part, the upper part may be developed analogously as a counterform. But it is also possible to develop one of the two tool parts as a rubber cushion press form.

An execution of the plate press tool according to the invention permits not only within specific limits desired thermal lengths to various heat exchange plates, but also offers the possibility to produce special plates whose center part has a gradually changing flow characteristic. The center part can, for example, begin in the upper zone with a row of fields comprising a large angle $\alpha$ and, by gradually decreasing the angle per row, end up with a small angle $\alpha$ in the lower zone.

Such plates are suitable for a heat exchange of materials whose viscosity greatly changes with a change in temperature. Then the zone with the small angle $\alpha$—thus with the profile which offers less flow resistance—is used on that side where the flow medium has a higher viscosity.

A further field of application of such special plates are plate evaporators in which, due to a partial evaporation of the fluid in the plate channel, there occurs a great increase in volume. In that case the medium, which ought to be evaporated, is allowed to enter at that end of the plate the profile of which causes the greatest flow resistance.

Although the present invention has been described in some detail by way of illustration and example for purposes of clarity and understanding, it will, of course, be understood that various changes and modifications may be made in the form, details, and arrangements of the parts without departing from the scope of the invention as set forth in the following claims.

What is claimed is:

1. A stackable plate heat exchanger comprising a plurality of heat exchange plates made from sheet metal, each of said heat exchange plates has a center part which is used for heat exchange and is provided with a plurality of parallel wavelike impressions which, extend transversely to a longitudinal axis of the plate, the wavelike impressions of neighboring plates crossing one another, said wavelike impressions being in juxtaposition to each other and being arranged in a plurality of circular wave fields which are dense and cover substantially the center part of the plate; and said wavelike impressions form a predetermined angle with respect to said longitudinal axis of said plate, whereby a heat exchanger having a predetermined thermal length is obtained.

2. A plate heat exchanger according to claim 1, wherein said circular wave fields of said neighboring plates overlap.

3. A plate heat exchanger according to claim 1, wherein said circular wave fields are mounted so that spaces which are defined between said circular wave fields are covered by a wave field of a neighboring plate.

4. A plate heat exchanger according to claim 1, wherein said predetermined angle is generally within the range of from at least about 30° to at least about 60°.

5. A plate heat exchanger according to claim 1, wherein said wave like impressions are formed in a plurality of rows.

6. A plate heat exchanger according to claim 5, wherein a transverse center line through each said heat exchanger plate divides said rows into equal halves, and each said half having all said rows with wavelike impressions oriented with equal, but oppositely disposed predetermined angles.

7. A plate heat exchanger according to claim 5, wherein said wavelike impressions of each said row exhibits a constantly changing wave direction.

8. A plate heat exchanger according to claim 5, wherein among said at least one circular wave field are remaining spaces which are provided with smaller circular fields of wavelike impressions.

* * * * *